United States Patent [19]

Johnston

[11] Patent Number: 4,493,324

[45] Date of Patent: Jan. 15, 1985

[54] PACIFIER COVER

[75] Inventor: Laverne Johnston, Simi Valley, Calif.

[73] Assignee: Dan LaMere, Sherman Oaks, Calif. ; a part interest

[21] Appl. No.: 505,306

[22] Filed: Jun. 17, 1983

[51] Int. Cl.[3] ..... A61J 17/00

[52] U.S. Cl. ..... 128/360

[58] Field of Search ..... 128/360, 359

[56] References Cited

U.S. PATENT DOCUMENTS

| | | | |
|---|---|---|---|
| 2,834,350 | 5/1958 | Beck, Jr. et al. | 128/360 |
| 2,860,639 | 11/1958 | Hoover | 128/359 |
| 4,329,996 | 5/1982 | Copeland | 128/360 X |
| 4,381,785 | 5/1983 | Robbins | 128/360 X |

FOREIGN PATENT DOCUMENTS

| | | | |
|---|---|---|---|
| 19385 | 9/1934 | Australia | 128/360 |
| 552888 | 1/1923 | France | 128/360 |
| 254945 | 1/1949 | Switzerland | 128/360 |
| 123221 | 2/1919 | United Kingdom | 128/360 |

*Primary Examiner*—William H. Grieb

*Attorney, Agent, or Firm*—Thomas I. Rozsa

[57] ABSTRACT

The present invention relates to an improved cover for a pacifier which completely seals the nipple of the pacifier to prevent it from getting dirty or collecting germs and further serves to completely protect the nipple to prevent it from becoming damaged during the periods when it is not used. Through use of the present invention, the nipple can be covered and protected during periods of non-use so that the baby is assured of placing a clean and undamaged nipple into his or her mouth during periods of conventional use such as sucking and biting the nipple.

9 Claims, 5 Drawing Figures

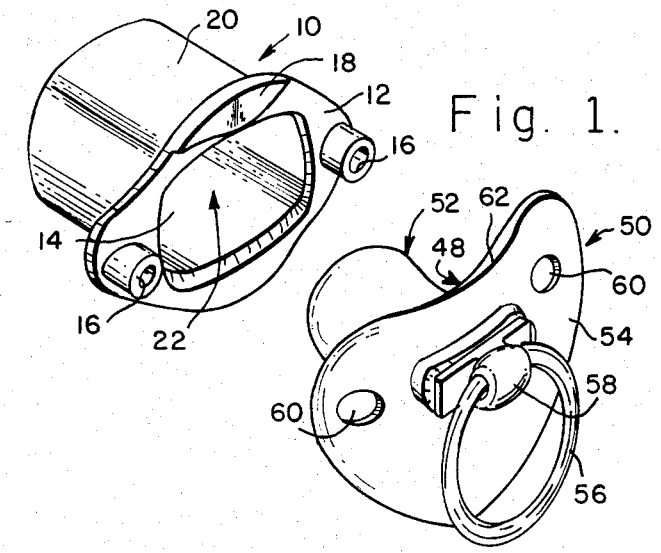
Fig. 1.
Fig. 2.
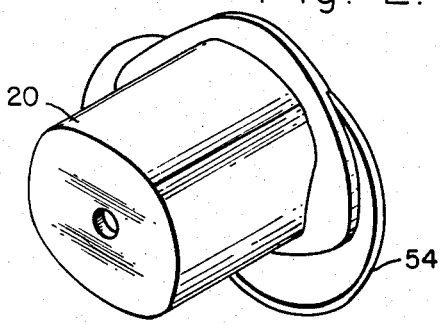
Fig. 3.
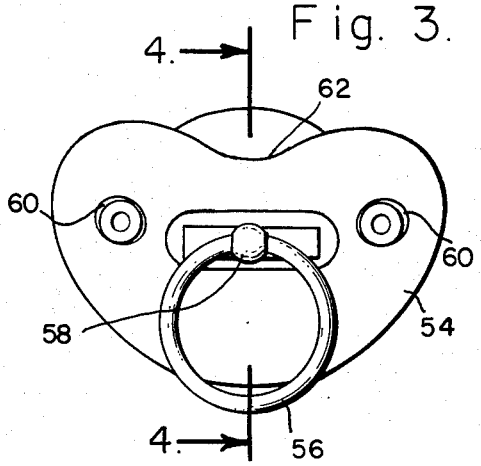
Fig. 4.
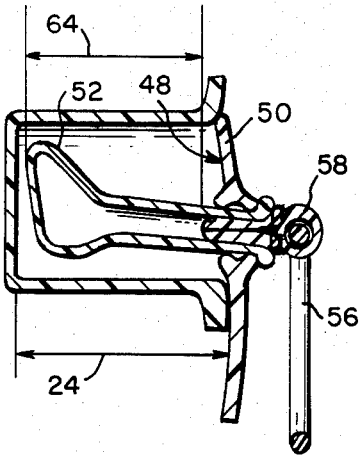
Fig. 5.
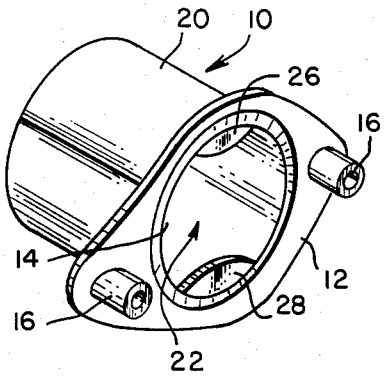

PACIFIER COVER

BACKGROUND OF THE INVENTION

1. FIELD OF THE INVENTION

The present invention relates to an improved cover for a pacifier. A pacifier is a nipple shaped device for babies to suck or bite upon. The nipple of the pacifier is usually attached to a nipple retaining member which in turn can be movably fastened to the baby's bed or stroller. The nipple is usually left in a fully exposed condition. While this is desirable when the nipple is in use, it is highly undesirable when the nipple is not in use. It is very easy for germs to collect on the nipple while it rests on the baby's bed or comparable location. It is also very easy for the nipple to become dirty during this period of non-use. It is also easy for the nipple to become damaged while it is being stored during non-use. If the baby subsequently takes the nipple into his or her mouth after it has become dirty, damaged or has collected germs, it is easy for the baby to become ill or injured. The present invention eliminates these problems through the creation of a pacifier cover which protects the nipple during the time that it is not in use.

2. DESCRIPTION OF THE PRIOR ART

The applicant is not aware of any prior art which even remotely resembles the present invention. Pacifiers are sold without covers with the nipple in a fully exposed position. When not in use, the pacifier is stored in a drawer or closet. The owner may seek to protect the nipple by covering it with paper or a piece of cloth. The owner may also place the pacifier in a box or comparable container. While this form of protection is certainly better than nothing, it is still very limited in its usefulness. There is no rigid protection around the nipple and so it can still be damaged. Since the area around the nipple is not completely sealed, it is still likely that the nipple can become dirty or collect germs.

Therefore, the prior art consists of makeshift endeavors on the part of owners to protect the nipple of the pacifier since no-one has ever thought to produce a truly effective cover which will seal the nipple to prevent it from becoming dirty and at the same time fully protect the nipple to prevent it from being damaged.

SUMMARY OF THE PRESENT INVENTION

The present invention relates to an improved cover for a pacifier which completely seals the nipple of the pacifier to prevent it from getting dirty or collecting germs and further serves to completely protect the nipple to prevent it from becoming damaged during the periods when it is not used. Through use of the present invention, the nipple can be covered and protected during periods of non-use so that the baby is assured of placing a clean and undamaged nipple into his or her mouth during periods of conventional use such as sucking and biting the nipple.

It has been discovered, according to the present invention, that if a cover is formed which contains a chamber with an opening whose general cross-section is slightly larger than and in the same approximate shape as the overall cross-section of the nipple and whose chamber depth is slightly larger than the length of the nipple, then the cover can be used to effectively seal the nipple to prevent it from becoming dirty or collecting germs during periods of non-use.

It has also been discovered, according to the present invention, that if the pacifier cover contains a multiplicity of male mating members which can be accommodated directly into openings or female members in the nipple retaining member of the pacifier, then the pacifier cover can be securely retained in place while covering the nipple. It has additionally been discovered, according to the present invention, that if the front exterior portion of the pacifier cover contains a protrusion which conforms to and can engage a portion of the nipple retainer when the male mating members are engaged into the openings of the nipple retainer, then the pacifier cover can further be securely attached to the nipple retaining member to protect the nipple during periods of non-use.

It is therefore an object of the present invention to provide a pacifier cover which will closely cover the nipple of a pacifier to assure that it is sealed during periods of non-use. In this manner, the nipple will be protected from becoming dirty and will not collect germs during the period of non-use.

It is an additional object of the present invention to provide a pacifier cover design which will permit the pacifier cover to be locked in place on the retaining member of the nipple to thereby assure that the pacifier cover will be firmly attached to the retaining member and cover the nipple during the period of non-use of the pacifier.

Further novel features and other objects of the present invention will become apparent from the following detailed description, discussion and the appended claims, taken in conjunction with the drawings.

DRAWING SUMMARY

Referring particularly to the drawings for the purpose of illustration only and not limitation there is illustrated:

FIG. 1 is a perspective view of the present invention pacifier cover separated from but aligned with a conventional pacifier just prior to insertion.

FIG. 2 is a rear perspective view of the pacifier cover after it has been inserted into engagement with the nipple retaining member on the pacifier.

FIG. 3 is a front view of the pacifier cover and a rear view of the pacifier after the pacifier cover has been inserted into engagement with the nipple retaining member on the pacifier.

FIG. 4 is a cross-sectional view taken along line 4—4 of FIG. 3, with the pacifier cover in mating engagement with the pacifier.

FIG. 5 is a front perspective view of an alternative embodiment of a pacifier cover.

DETAILED DESCRIPTION OF THE PREFERRED EMBODIMENT

Although specific embodiments of the invention will now be described with reference to the drawings, it should be understood that such embodiments are by way of example only and merely illustrative of but a small number of the many possible specific embodiments which can represent applications of the principles of the invention. Various changes and modifications obvious to one skilled in the art to which the invention pertains are deemed to be within the spirit, scope and contemplation of the invention as further defined in the appended claims.

A conventional pacifier which is commercially produced today is illustrated in the perspective view of FIG. 1. The pacifier 50 comprises in combination a nipple 52 located and protruding from the front face 48 of the pacifier 50 and a nipple retaining member 54 which holds the nipple 52 in a fixed position relative to the nipple retaining member 54. At the rear of the nipple retaining member is a ring 56 which is rotatably attached to the rear of the nipple retaining member 54 by attachment means 58. The ring 56 permits the pacifier 50 to be tied to a bedpost or baby's carriage. The nipple retaining member 50 also contains a multiplicity of holes or female mating members 60. The pacifier in the illustration is shown with two such holes or female mating members 60. While this is the conventional design for the pacifiers which are commercially produced today, it will be appreciated that a pacifier with any multiplicity of such holes or female mating members 60 can be easily produced. As shown in FIG. 1 and also in the cross-sectional view of FIG. 4, the front face 48 of nipple retaining member 54 is of generally concave design with the concave portion extending in the same direction as the nipple 52. The overall cross-sectional design of the nipple retaining member 54 is generally heart shaped, with a concave surface 62 on its top. The overall cross-sectional design of the nipple 52 is oval-shaped in the pacifier design shown in FIG. 1.

One embodiment of the present invention pacifier cover is shown in FIG. 1 and one alternative embodiment of the present invention is shown in FIG. 5. Referring specifically to FIG. 1, the pacifier cover is shown at 10. The pacifier cover is of one piece construction and by way of example only can be molded or extruded from plastic. The front face 12 of the pacifier cover 10 is of generally convex design which is designed to conform to and can mate precisely with the concave design of the front face 48 of the nipple retaining member 54 of the pacifier 50. The front face 12 of pacifier cover 10 contains an opening 14 whose cross-section is of the same general cross-section as the nipple 52 and whose cross-sectional size is slightly larger than the cross-sectional size of the nipple 52. The front face 12 also contains two other important elements. First, the front face contains a multiplicity of male mating members 16 which are aligned to correspond with the holes or female mating members 60 in the nipple retaining member 54. When the pacifier cover 10 is brought into contact with the pacifier 50, each male mating member 16 is inserted into the aligned and corresponding female mating member 60 to thereby hold the pacifier cover 10 into firm engagement with the pacifier 50. The other important feature of the front face 12 of the pacifier cover 10 is a generally convex protrusion 18 on the upper portion of the front face 12. The convex design of the protrusion 18 corresponds exactly to the concave top surface 62 of the nipple retaining member 54. Therefore, when the pacifier cover 10 is brought into contact with the pacifier 50, in addition to the male mating members 16 engaging the holes or female mating members 60, the convex protrusion 18 of the pacifier cover 10 engages the concave top surface 62 of the nipple retaining member 54 to further assure a firm locking engagement between the two parts. The balance of pacifier cover 10 consists of a hollow enclosed cover portion 20 which opens at face opening 14. The internal chamber 22 of cover portion 20 has a cross-section which is of the same general cross-section as opening 14. The depth 24 of chamber 22 is slightly larger than the length 64 of nipple 52. Therefore, when nipple 52 is inserted into chamber 22 of the hollow cover portion 20 through its open face 14, the nipple 52 is closely retained within the chamber 22 of hollow cover portion 20.

The combined assembly of the present invention pacifier cover 10 in engagement with the pacifier 50 is shown from the rear in FIG. 2 and from the front in FIG. 3. As best illustrated in the front view of FIG. 3, each male mating member 16 is engaged into a corresponding one of the holes or female mating members 60 and the convex protrusion 18 on the pacifier cover 10 engages the concave top surface 62 on the nipple retaining member 54 to thereby hold the two pieces into firm engagement with each other. Defined more broadly, the pacifier cover 10 contains a protrusion on its front face whose exterior circumference conforms to the shape of the top surface of the nipple retaining portion of the pacifier to thereby assure a firm locking engagement between the two parts when they are brought together. The front face 12 of the pacifier cover 10 is also designed to correspond and conform in shape to the front face 48 of the nipple retaining member 54 to further assure an air-tight seal between the two parts when they are engaged.

The cross-sectional view of FIG. 4 shows that the fit between the two parts is air-tight. The nipple 52 is closely engaged within the chamber 22 of hollow cover portion 20 of the pacifier cover 10 to assure a firm and secure engagement which is air-tight and which will: (1) protect the nipple 52 from being damaged, (2) protect the nipple 52 from getting dirty, and (3) protect the nipple 52 from collecting germs.

As previously mentioned, the cross-section of the interior hollow chamber 22 of the cover portion 20 of the pacifier cover 10 and its associated opening 14 in the face 12 of the pacifier cover 10 is approximately the same general cross-section and size as the cross-section and size of nipple 52 on the pacifier 50. An alternative embodiment of the present invention is disclosed in FIG. 5. The only difference here is that the cross-section of the chamber 22 in hollow cover portion 20 and its associated opening 14 in face 12 of the pacifier cover 10 is circular instead of oval. Also, instead of one protrusion 18 extending from the top of the face, there are a pair of arcuate inwardly extending protrusions 26 and 28. This alternative embodiment is designed to cover a pacifier whose nipple is of generally circular cross-section and whose nipple retaining member contains a surface which corresponds in general shape to the arcuate protrusions 26 and 28 on the pacifier cover.

It is also within the spirit and scope of the present invention to have the protrusion 18 on the lower portion of front face 12 and conform to the lower surface of nipple retaining member 54. Also, one protrusion 18 may be on one or both sides of the front face 12 and conform to the corresponding side or sides of the nipple retaining member 54.

The nipple retaining member 50 is usually made out of molded or extruded plastic and therefore in the preferred embodiment of the present invention pacifier cover 10 is also made out of molded or extruded plastic material. It is however within the spirit and scope of the present invention for the pacifier cover 10 to be made out of any other type of material such as any polycarbonate material or metal. The front surface 12 of the pacifier cover is designed to correspond and conform to the front surface 48 of the nipple retaining member 54 of the pacifier, to thereby assure a firm and air-tight engagement between the two parts. In the case of the pacifier illustrated where its nipple retaining member front face 48 was generally concave in shape, the front face 12 of the pacifier cover was designed to be generally convex in shape to thereby correspond to the front face 48 of the nipple retaining member. If the front face of the nipple retaining member was generally convex in shape, then the front face of the pacifier cover would be designed to be generally concave in shape for an accommodating engagement. Similarly, the number of and alignment of male mating members on the front face of the pacifier cover correspond to the number of and alignment of the holes of female mating members in the particular design of the nipple retaining member of the pacifier.

Of course, the present invention is not intended to be restricted to any particular form or arrangement, or any specific embodiment disclosed herein, or any specific use, since the same may be modified in various particulars or relations without departing from the spirit or scope of the claimed invention herein above shown and described of which the apparatus shown is intended only for illustration and for disclosure of an operative embodiment and not to show all of the various forms of modification in which the invention might be embodied or operated.

The invention has been described in considerable detail in order to comply with the patent laws, by providing a full public disclosure of at least one of its forms. However, such detailed description is not intended in any way to limit the broad features or principles of the invention, or the scope of patent monopoly to be granted.

What is claimed is:

1. A pacifier cover for covering and protecting the nipple which is supported by a nipple retaining member of the pacifier, wherein the nipple protrudes from the front face of the nipple retaining member and the nipple retaining member contains a multiplicity of holes, wherein the pacifier cover comprises:

a. a hollow cover portion containing an internal chamber therein;

b. said internal chamber opening into the front face of the pacifier cover;

c. the shape of the front face of the pacifier cover conforming to the shape of the front face of the nipple retaining member of said pacifier;

d. said front face of said pacifier cover containing a protrusion on the upper portion of its front face which conforms in shape to the upper surface of the nipple retaining member of the pacifier; and e. said front face of said pacifier cover containing a multiplicity of male mating members each of which is aligned with a corresponding one of said holes in said nipple retaining member;

f. whereby when said pacifier cover is brought into engagement with said pacifier, said nipple is retained within said chamber, each of said male mating members is inserted into and retained within a corresponding one of said holes in said nipple retaining member, said protrusion on the upper portion of said front face of said pacifier cover engages the top surface of said nipple retaining member, and said front face of said pacifier cover is securely held against the front face of said nipple retaining member.

2. The invention as defined in claim 1 wherein said protrusion is on the lower surface of the front face of said pacifier cover and conforms to the shape of the lower surface of said nipple retaining member of said pacifier.

3. The invention as defined in claim 1 wherein said protrusion is on one side of the front face of said pacifier cover and conforms to the shape of the corresponding side of said nipple retaining member of said pacifier.

4. The invention as defined in claim 1 wherein the cross-section of said nipple is oval and the corresponding cross-section of said chamber and its opening is also oval and slightly larger than the cross-section of said nipple.

5. The invention as defined in claim 1 wherein the cross-section of said nipple is circular and the corresponding cross-section of said chamber and its opening is also circular and slightly larger than the cross-section of said nipple.

6. The invention as defined in claim 1 wherein the depth of said chamber is slightly larger than the length of said nipple.

7. The invention as defined in claim 1 wherein the front face of said nipple retaining member is concave and the front face of said pacifier cover is convex.

8. The invention as defined in claim 1 wherein the front face of said nipple retaining member is convex and the front face of said pacifier cover is concave.

9. The invention as defined in claim 1 wherein said nipple retaining member contains two holes on opposite sides and said pacifier cover contains two male mating members on opposite sides of its front face.

* * * * *